United States Patent [19]

Elsbett et al.

[11] Patent Number: 4,625,700

[45] Date of Patent: Dec. 2, 1986

[54] PLUNGER PUMP FOR DELIVERING LIQUIDS ESPECIALLY FUELS, FOR RECIPROCATING INTERNAL COMBUSTION ENGINES

[76] Inventors: Ludwig Elsbett; Günter Elsbett, both of Industriestr. 14, D 8543 Hilpoltstein, Fed. Rep. of Germany

[21] Appl. No.: 347,172

[22] Filed: Feb. 9, 1982

[30] Foreign Application Priority Data

Feb. 13, 1981 [DE] Fed. Rep. of Germany ..... 3105205

[51] Int. Cl.[4] ..... F02M 39/00

[52] U.S. Cl. ..... 123/500; 123/501; 123/357; 417/218

[58] Field of Search ..... 123/501–502, 123/500, 357, 504, 358–359; 417/218

[56] References Cited

U.S. PATENT DOCUMENTS

| | | | |
|---|---|---|---|
| 2,019,103 | 10/1935 | Thege | 123/504 |
| 2,396,602 | 3/1946 | Posch | 123/500 |
| 4,174,694 | 11/1979 | Wessel | 123/357 |
| 4,234,292 | 11/1980 | Berg | 417/218 |
| 4,368,705 | 1/1983 | Stevenson | 123/357 |
| 4,372,266 | 2/1983 | Hiyama | 123/357 |

FOREIGN PATENT DOCUMENTS

| | | | |
|---|---|---|---|
| 613373 | 4/1935 | Fed. Rep. of Germany | 123/501 |

*Primary Examiner*—Carl Stuart Miller
*Attorney, Agent, or Firm*—Peter K. Kontler

[57] ABSTRACT

A plunger pump wherein the plunger is reciprocable in a barrel by a tappet which is coupled to the plunger by a pressure member. The tappet is reciprocable by a rotary cam in conjunction with a coil spring and is movable axially of the plunger by a first drive having a sleeve surrounding the barrel and having jaws in engagement with complementary jaws of the pressure member. Rotation of the pressure member in response to rotation of the sleeve entails axial movement of the tappet because the latter has threads in mesh with complementary threads of the pressure member whereby the tappet changes the length of forward and return strokes of the plunger. The latter has a control edge which can regulate the volume of outflowing liquid in response to rotation of the plunger on actuation of a second drive having a second rotary sleeve with jaws engaging complementary jaws of the plunger.

9 Claims, 3 Drawing Figures

Figure 1:
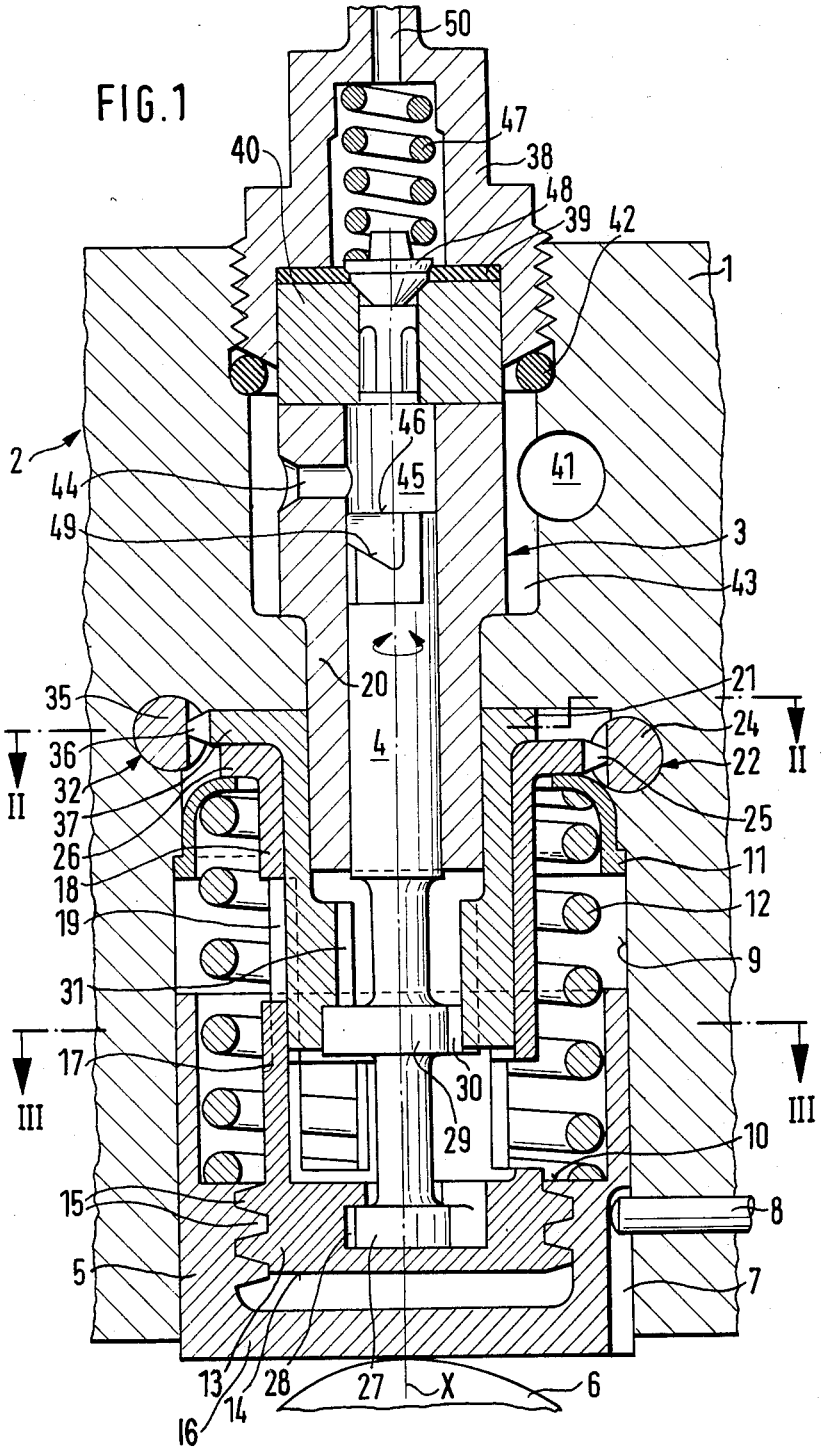

PLUNGER PUMP FOR DELIVERING LIQUIDS ESPECIALLY FUELS, FOR RECIPROCATING INTERNAL COMBUSTION ENGINES

This invention relates to a plunger pump for delivering liquids especially fuels, for reciprocating internal combustion engines, consisting of a casing with at least one barrel as well as a pump plunger which is axially slidable and turnable about its longitudinal axis in the barrel, the barrrel having at one end a joint for a connection leading to an injector and, at its other end, a tappet capable of moving the pump plunger axially, the plunger pump being provided with a drive capable of acting on the pump plunger to rotate the plunger about its longitudinal axis, the tappet being backed by spring means arranged in the casing and acting in opposition to its axial movement, the barrel being formed with a pressure chamber at its end facing the joint between the joint and the pump plunger, the pressure chamber connected through a port with a supply chamber which communicates with an inlet for the liquid, and the plunger in this plunger pump being formed at its end facing this pressure chamber with a control land (or edge) for adjusting the amount of a liquid volume to be delivered per degree crank angle from the port via the pressure chamber and its joint with the connection to the injector.

It is part of the art to equip reciprocating internal combustion engines, such as Diesel engines in particular with fuel pumps to introduce a fuel into the combustion chamber of such an internal combustion engine and to form these fuel pumps as plunger pumps with pumping elements arranged in line (in-line pumps) or with pump elements arranged about an axis (distributor pumps). In the case of high-speed internal combustion engines, such as for instance Diesel engines which have been finding increasing acceptance recently and which are also required to offer optimum performance over a wide speed range, it is necessary to compensate for an injection lag which varies according to the time to provide an injection timer which advances the start of delivery of the fuel by the pump element, referred to the top dead centre of the internal combustion engine or Diesel engine to an earlier time as the speed increases. This is effected by means of injection equipment, such as injection pumps with individual pump elements in a manner that the camshaft of such an injection pump which rotates synchronously at a predetermined ratio to the crankshaft of the internal combustion engine is turned in its position relative to the crankshaft within the synchronous cycle by means of a device which as a rule is mechanical and relies on the centrifugal force. In the case of injection pumps with a central distributor plunger (distributor pumps), this injection adjustment is as a rule effected hydraulically by turning a cam ring. Varying the start of delivery by the pump elements by turning the camshaft alone is not possible in the case of internal combustion engines with injection equipment having individual pump elements because these elements are actuated in common with the valves of the internal combustion engine from the same camshaft. This is because, simultaneously there would be a change in the timing of the valves which is in no way desirable. For these reasons, the adjustment of the start of delivery is varying the lift of the plunger in each individual injection or pump element which amounts to an adjustment of the displacement of the pump plunger from its bottom dead centre to the start of delivery by it. Such an adjustment is usually made by placing shims or washers whose thickness is accurately defined between the tappet and the pump plunger which involves shutting down the internal combustion engine.

A known plunger pump for delivering fuel into the combustion chamber of a reciprocating internal combustion engine of this type is essentially formed by a case with several pump elements arranged in line each having a pump plunger which is axially displaceable and serves to deliver the fuel. Each pump plunger which is connected with its one end to a tappet which moves it has at its other free end a control edge or land which, provided the stroke, i.e. the axial motion of the pump plunger is appropriately set and proportioned, defines the amount of fuel being delivered. For adjusting the control edge and, consequently, also the time of delivery by the pump plunger, the latter is positively (form-lockingly) connected by means of a jaw, to the jaws of a sleeve, the sleeve surrounding the barrel of the pump plunger concentrically and being connected with its end opposite the jaws with a mechanical control drive. The plunger, which is moved by a tappet axially of its barrel up and down in the latter, forces the fuel contained in the pressure chamber with its solid end through a delivery pipe into the allied combustion chamber to fill the pressure space again after delivery has been completed for the next cycle. In this manner, the plunger performs oscillating motions in the direction of its longitudinal axis in the barrel, adjustment of injection timing or adjustment of the position of the control edge being possible by rotating the pump plunger about its longitudinal axis by means of the control drive. Whereas a plunger pump of this type permits the position of the control edge relative to transverse ports in the barrel of the pump plunger to be adjusted for fuel admission, it is not possible with a plunger pump of this type also to adjust the lift of the pump plunger during operation of the internal combustion engine, whereby considerable difficulties are experienced in adjusting the amounts of fuel to be delivered (see German Patent Specification No. 22 10 164).

This is where the invention starts which has for its object to provide a plunger pump for the delivery of liquids, especially fuel, into combustion chambers of internal combustion engines whereby the adjustment of the amount of liquids to be delivered and, consequently, also of the injection timing is possible while the internal combustion engine is in operation, without it being necessary to interfere with the drive of the camshaft.

According to the invention, this object is achieved by means of a plunger pump of the type initially referred to in that, in addition to control means causing its rotation about its longitudinal axis, the pump plunger is also formed with a control drive varying its oscillating motions along its longitudinal axis and in that this control drive is provided with control elements brought out of the pump barrel and operable also during operation of the internal combustion engine.

An advantageous further development of the invention is distinguished in that the control drive for varying the oscillating motion along the longitudinal axis is formed by a cup-shaped tappet capable of being moved axially typically by a cam and having pressure means arranged inside and concentrically to it, said pressure means being provided on its outer surface, but in the region of its solid end and the tappet on its inner surface, but also in the region of its solid end, with all interlocking (form-locking) thread each and in that this pressure member is formed at its end opposite its solid end with at least one jaw for which another jaw meshing with the former is provided on another jaw sleeve which concentrically surrounds a flanged sleeve which rotates the plunger about its longitudinal axis, and in that this jaw sleeve with its end opposite its jaws is typically connected to a drive which rotates this jaw sleeve independently of the other motions of the flanged sleeve separately and in that this drive which is typically formed as a control drive the jaw sleeve is rotatable about the longitudinal axis of the pump plunger and the cup-shaped pressure member is made axially slidable along the longitudinal axis of the pump plunger.

These features not only provide an advantageous solution for the objective underlying this invention, but an additional bonus is obtained in that the plunger pump can be accommodated in relatively inaccessible spaces on the internal combustion engine itself, because variation of the lift of the pump plunger and adjustment of the start of delivery can be provided for by control elements which are brought out and do not call for shutting down of the internal combustion engine nor the removal of the plunger pump. Another advantage of the invention can be seen in the fact that conventional and proven control elements such as are used for the timing adjustment and rotating the flanged bush respectively can also be used for rotating the pressure member about the longitudinal axis of the pump plunger whereby the pressure member meshing with the plunger through the thread is moved axially. Studies of the plunger pump according to the invention have shown that the use of such a control element for adjusting the pump plunger along its longitudinal axis enables the adjustment to be effected with an extremely small positioning force for rotating the cup-shaped pressure member on which the jaws are formed and that, in addition, this adjusting element is acted upon only during the adjustment of the pressure member, e.g. by the hydraulic positioning forces, but not by the forces of the spring which pushes the tappet back. Thus, the plunger pump according to the invention permits the use of hitherto known and low-cost pump elements also to vary the axial path of the pump plunger which offers an additional advantage in that, especially the maintenance operations can rely extensively on the technology of injection timers with which they are familiar.

Furthermore, with the plunger pump according to the invention it is possible by obliquely positioning the upper edge of the pump plunger to correlate the start of delivery additionally with respect to the delivery rate of the liquid, e.g. fuel. In this manner, it is possible, depending on the profile of the cam, to shift the variation of the delivery stroke into a range of reduced or increased or constant velocity of the pump plunger whereby additional biassing of the injection characteristic is made possible in a simple manner. The features according to the invention moreover have the advantage that delivery of the liquid, e.g. the injection of a fuel into the combustion chamber of an internal combustion engine does not call for any separate pumping equipment, but these and/or the plunger pump according to the invention or only its pumping elements and/or functional parts may be integrated into the internal combustion engine. A substantial simplification would also derive from the omission of an external unit and all drives required for it as well as the omission of a large and heavy injection timer of the usual type for high positioning forces.

Another advantage of the invention can be seen in the fact that the pump and/or its principle can also be applied where so-called unit injectors are used in as much as the pumping element of these unit injectors would be operated according to the same principle according to the invention. Furthermore, it is also possible where the principle according to the invention is adopted to form and manufacture its cylinder head for a high-speed internal combustion engine with a wide speed range so that it will represent a compact unit with all essential parts governing the performance of the internal combustion engine, such as air and exhaust passages, valves, camshaft, injectors, injection pumps and injection governor. In such a case, the cylinder head would incorporate a combination of conventional control elements for the valves and new open-loop and closed-loop control elements for the plunger pump. This combination would also substantially reduce the space required for the internal combustion engine and certainly help to reduce injection noise. Another important advantage of the invention can be looked upon to reside in the fact that, in particular the makers of internal combustion engines will no longer have to rely on a complicated injection pump for which there are only a few highly specialized suppliers in as much as he can fall back on simple parts which are offered by numerous makers in the component market or the maker may even produce these few complicated parts himself.

An advantageous further development of the invention features a jaw sleeve which is an integral part of an electric drive and provision for this drive to be individually variable and/or variable by controlling factors derived from parameters of the internal combustion engine, such as travelling speed, barometric pressure, air temperature, quality of the fuel etc.

These features offer an advantage in as much as an easy-to-operate and conveniently accessible input is possible on the injection timer which is not always a simple matter in the case of existing rotating type injection timers of the conventional kind, but desirable in view of the increasing acceptance of electronic control facilities in the future.

Figure 2:
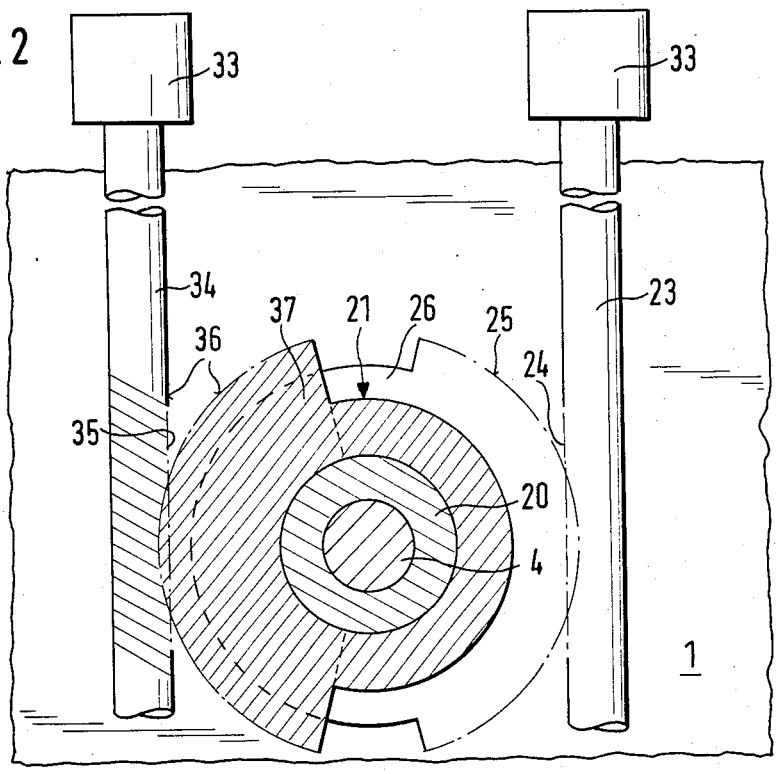
Figure 3:
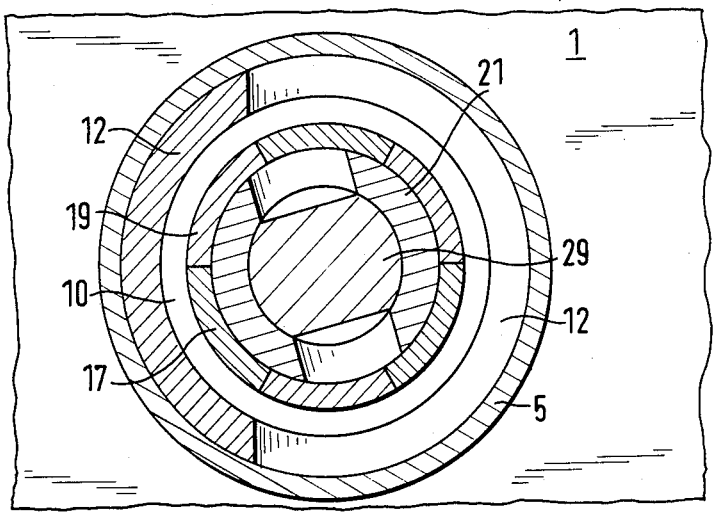

A typical embodiment of the invention is shown schematically in the accompanying drawing in which FIG. 1 is a longitudinal centre section through a pump element of a plunger pump with the pump casing shown only partly and sectioned transversely, FIG. 2 is a cross-section through the pump element along the plane II—II in FIG. 1 and FIG. 3 is a cross-section through the pump element along the plane III—III in FIG. 1.

Arranged in a casing 1 of a plunger pump 2 for delivery of fluids, e.g. fuels to the combustion chambers of an internal combustion engine which is not shown in the drawing, there is at least one pump element 3 which is essentially formed as a plunger-barrel drive, the pump plunger 4 of which is operated by a tappet 5 which, in turn, is operated by a cam 6 which is only schematically shown in the drawing and which pump plunger is caused to perform oscillating axial motions. The tappet 5 is located in the casing 1 by means of a pin 8 registering in a longitudinal groove 7 of the tappet to prevent it from turning about the longitudinal axis X of the pump element 3 and the tappet is preferably of cup shape and arranged axially slidably in a cylindrical recess 9 of the casing. In order to be able to return the tappet 5 after every axial motion which is performed due to the pressure of the cam 6 into its initial position, a spring 12 is clamped between a preferably step-shaped seat 10 of the tappet and a cup-shaped sleeve 11 supported in the casing 1 so that as the cam 6 is rotated an oscillating motion is produced for the axial displacement of the pump plunger 4. Inside the tappet 5 and concentrically to it there is a pressure member 13 also of cup shape which on its surface and preferably only over a height near its solid end 14 is formed with a thread 15 for which another thread 15 is provided on the inner surface of the tappet, also near its solid end 16 which meshes with the former thread. The end of this pressure member 13 opposite the solid end 14 is formed with at least one, but preferably three, jaws 17 for which (mating) jaws 19 are provided on a jaw sleeve 18 which jaws are in constant mesh with the other jaws. The jaw sleeve 18, which is arranged concentrically around a flanged sleeve 21 which surrounds the barrel 20 of the pump plunger 4 also concentrically, is connected to a control drive 22 by means of which the jaw sleeve 18 can be turned about its longitudinal axis X when required. The control drive 22, which in a simple form is constructed as a control rod 23 with at least one half gear 24 per jaw sleeve 18 fitted to it, is positively (form-lockingly) connected via its halfgear with gear teeth 25 on the jaw sleeve 18, these gear teeth being preferably provided on a segment of a ring flange 26 of the jaw sleeve. The pump plunger 4 which is revolving and guided axially slidably in the barrel 20 extending concentrically around it, is formed at its end facing the pressure member 13 with a ring collar 27 for which a recess 28 is provided in the solid end 14 of the pressure member. The recess 28 for the ring collar 27 is formed in a manner that the ring collar can turn about the longitudinal axis X of the pump plunger 4, but cannot unintentionally leave the recess. In addition to this ring collar 27, the pump plunger 4 is formed with another collar 29 which is preferably of jaw shape and for whose jaw 30 other (mating) jaws 31 are provided on the flanged sleeve 21. This flanged sleeve 21, which is arranged around the barrel 20 of the pump plunger 4, is connected, similar to the jaw sleeve 18, to a control drive permitting it to be also rotated about the longitudinal axis X as required. A control rod 34 connected to a governor 33 may also serve as a control drive 32 here, the control rod 34 being arranged analogously to the control drive 22 of the jaw sleeve 18 to act on the flanged sleeve 21 via a half gear 35 on the control rod and gear teeth 36 on a ring flange 37 of the flanged bush 21. Any rotating motion of this flanged bush 21 about the longitudinal axis X of the pump plunger 4 causes the latter, because of the positive (form-locking) connection between its collar 29 and its jaws 31 of the flanged bush 21 to be engaged and rotated accordingly about the longitudinal axis X. The pump plunger 4, in turn, which is a fit in the barrel 20 can thus be turned about its longitudinal axis X by means of the flanged bush 21 and simultaneously or separately be raised or lowered axially due to the axial displacement of the pressure member 13.

The barrel 20 is fixedly installed in the casing 1 at the end opposite the fixing or ring collar 27 of the pump plunger by means of a screw insert 38 and a gasket 39 as well as a valve body 40. The liquid e.g. the fuel, flows from an inlet port 41 in the casing 1 of the plunger pump 2 into a suction space 43 which is sealed by means of an O-ring 42 and, via a control port 44 which enters this suction space, into a space 45 above an upper edge 46 of the pump plunger 4. As the pump plunger 4 is moved in the direction of the valve body 40 by the tappet 5, the control port 44 is covered by the upper edge 46 of the pump plunger 4 during its stroke. This point, or overlapping of the control port 44 by the upper edge 46 of the pump plunger 4 is defined as the so-called "start of delivery". As the pump plunger 4 is raised further, liquid is delivered through the valve 48 which opens against a spring 47. This point, or this stroke respectively, is defined as the so-called "delivery stroke". The delivery stroke is deemed to have been completed when the connection to the suction space 43 is restored via the control port 44 by the oblique control edge 49 at the upper end of the pump plunger 4. The amount of liquid delivered through a connection 50 to a consumer or combustion chamber not shown in the drawing is a function of the length of the overlapping stroke, i.e. the position of the oblique control edge 49. In order to vary the amount delivered also during operation, e.g. of an internal combustion engine, the pump plunger 4 is guided slidably in the flanged bush 21 which is capable of being turned by the actuation of the control drive 32 via the control rod 34 and the gear teeth 36. If then it is desired that the start of delivery be varied in addition, the invention provides for turning of the pressure member 13 in the thread 15 to increase the distance of the upper edge 46 of the pump plunger 4 from the control port 44 and, consequently also the stroke of the pump plunger whereby a variation of the start of delivery is effected. The pressure member 13 is connected by means of the jaws 17 to the jaw sleeve 18 the position of which can also be varied during operation by means of its control drive 22.

The typical embodiment has been represented and described here only on the basis of one pump element 3. It is of course possible to arrange several pump elements 3 in the casing 1 in line and to control these in synchronism with the crankshaft by the same control drives 22, 32 or the governor 33. Actuation of the control drive 22, 32 can be provided in a manner known per se, e.g. hydraulic governors or centrifugal governors. The important thing is that the individual pump plungers 4 can have their oscillating motions varied in their strokes by displacing them so that, as a result of the variation of their strokes between the admission port or control port 44 and the control edge 49 there is also a change of the start of delivery for the liquid.

We claim:

1. A plunger pump for delivering liquids, particularly for delivering fuels to reciprocating internal combustion engines, comprising a casing having an outlet; a barrel in said casing; a plunger reciprocably and angularly displaceably installed in said barrel and arranged to expel liquid via said outlet while performing a delivery stroke in said barrel and to move relative to said barrel without expulsion of liquid while performing a lift stroke preceding the respective delivery stroke; a tappet reciprocably installed in said casing and indirectly coupled to said plunger to impart reciprocatory movements thereto; means for reciprocating said tappet including rotary cam means for moving the tappet axially in a direction to cause said plunger to perform forward strokes each of which includes a lift stroke followed by a delivery stroke, and spring means yieldably opposing the movement of said tappet under the action of said cam means, said casing and said barrel having means defining a path for the flow of liquid into said barrel while said plunger performs a return stroke under the action of said spring means and for the flow of liquid from said barrel into said outlet when the plunger performs a delivery stroke, said plunger having a control edge arranged to alter the volume of liquid, which is expelled via said outlet during a delivery stroke of said plunger, in response to angular displacement of said plunger in said barrel; first drive means for changing the angular position of said plunger in said barrel including a first sleeve having at least one first jaw and axially movably guiding said plunger, at least one second jaw provided on said plunger and arranged to receive torque from said first jaw, and means for rotating said sleeve; and second drive means for changing the axial position of said plunger relative to said tappet to thereby vary the lift and return strokes of the plunger, including a second sleeve having at least one third jaw, a one-piece pressure member coupled with said plunger for axial movement therewith and having first threads mating with second threads provided on said tappet and at least one fourth jaw arranged to receive torque from said third jaw, and means for rotating said second sleeve to thereby move said pressure member and said plunger axially of said tappet by way of said third jaw and said threads.

2. The pump of claim 1, wherein said tappet has an axially parallel groove and further comprising a pin extending from said casing into said groove to hold said tappet against rotation in the casing.

3. The pump of claim 1, wherein each of said sleeves and the respective rotating means have mating gear teeth, the jaws of said sleeves being remote from the respective gear teeth, as considered in the axial direction of said plunger.

4. The pump of claim 3, wherein said first sleeve has a ring flange and the respective gear teeth are provided on said ring flange, said means for rotating said first sleeve comprising a rotary control rod provided with the respective gear teeth.

5. The pump of claim 1, wherein one of said sleeves surrounds the other of said sleeves and is axially movable relative thereto.

6. The pump of claim 1, wherein the pitch of said threads is matched to the forward stroke of said plunger.

7. The pump of claim 1, wherein said second drive means is arranged to move said pressure member axially as a function of the rotational speed of said cam means.

8. The pump of claim 1, wherein at least one of said rotating means is operable by hydraulic, pneumatic, mechanical or electronic governor means.

9. The pump of claim 1, wherein at least one of said drive means is installed in the cylinder head of an internal combustion engine.

* * * * *